US011274026B2

(12) United States Patent
Barron

(10) Patent No.: US 11,274,026 B2
(45) Date of Patent: Mar. 15, 2022

(54) DISPENSER CARTRIDGE FOR THE COOLED STORAGE AND DISPENSING OF LIQUID OR SEMI-LIQUID FOODSTUFFS AND DISPENSER MACHINE FOR THE USE OF SUCH A DISPENSER CARTRIDGE

(71) Applicant: Syntegon Pouch Systems AG, Beringen (CH)

(72) Inventor: Dan Barron, Schaffhausen (CH)

(73) Assignee: SYNTEGON POUCH SYSTEMS AG, Beringen (CH)

( * ) Notice: Subject to any disclaimer, the term of this patent is extended or adjusted under 35 U.S.C. 154(b) by 205 days.

(21) Appl. No.: 16/047,891

(22) Filed: Jul. 27, 2018

(65) Prior Publication Data

US 2019/0031482 A1 Jan. 31, 2019

(30) Foreign Application Priority Data

Jul. 27, 2017 (DE) ..... 10 2017 212 949.2

(51) Int. Cl.
*B67D 1/00* (2006.01)
*B67D 1/08* (2006.01)
(Continued)

(52) U.S. Cl.
CPC ..... *B67D 1/0004* (2013.01); *B67D 1/0857* (2013.01); *B67D 1/108* (2013.01);
(Continued)

(58) Field of Classification Search
CPC .. B67D 1/0857; B67D 3/0009; B67D 3/0022; B67D 3/0029; F25D 17/04; F25D 17/06; F25D 23/061; F25D 2317/061
See application file for complete search history.

(56) References Cited

U.S. PATENT DOCUMENTS 6,871,015 B2 * 3/2005 Gutierrez ..... B67D 1/0004 222/146.1
7,137,438 B2 * 11/2006 Nomura ..... A47F 3/0443 165/64
(Continued)

FOREIGN PATENT DOCUMENTS

CN 1204756 A 1/1999
CN 1742662 A 3/2006

OTHER PUBLICATIONS

Chinese Patent Office First Office Action for Application No. 201810824441.1 dated Jan. 15, 2021 (11 pages including English translation).

(Continued)

*Primary Examiner* — Brian M King
(74) *Attorney, Agent, or Firm* — Micheal Best & Friedrich LLP

(57) ABSTRACT

A dispenser cartridge (10) which comprises a first and a second cartridge shell (11, 12). The two cartridge shells (11, 12) are connected via a hinge (14). The two cartridge shells delimit a receiving space (25) for tubular bags. Each cartridge shell has a cooling trough (30) which, apart from an inlet port (26) and ventilation openings (33), is closed to the receiving space (25) for the tubular bags by a thermally conductive plate (18). The receiving volume of the cooling trough (30) is kept as low as possible. The depth of the cooling trough (30) corresponds to a maximum of twice the thickness of the thermally conductive plate (18). The greater the volume of the receiving space (25) for corresponding tubular bags, the greater the thickness of the thermally conductive plate (18).

18 Claims, 7 Drawing Sheets

(51) Int. Cl.
*B67D 1/10* (2006.01)
*B67D 3/00* (2006.01)

(52) U.S. Cl.
CPC ..... *B67D 3/0009* (2013.01); *B67D 3/0022* (2013.01); *B67D 3/0029* (2013.01); *B67D 2001/0827* (2013.01); *B67D 2210/00118* (2013.01)

(56) References Cited

U.S. PATENT DOCUMENTS

| | | | | |
|---|---|---|---|---|
| 7,147,134 | B2 * | 12/2006 | Gutierrez | B67D 1/0004 222/146.1 |
| 2010/0252694 | A1 * | 10/2010 | Bathols | B65F 1/1415 248/101 |
| 2015/0053308 | A1 * | 2/2015 | Barron | B67D 7/0288 141/314 |
| 2018/0134435 | A1 * | 5/2018 | Barron | B65B 69/005 |

OTHER PUBLICATIONS

Chinese Patent Office Second Office Action for Application No. 201810824441.1 dated Aug. 12, 2021 (7 pages including English translation).

* cited by examiner

DISPENSER CARTRIDGE FOR THE COOLED STORAGE AND DISPENSING OF LIQUID OR SEMI-LIQUID FOODSTUFFS AND DISPENSER MACHINE FOR THE USE OF SUCH A DISPENSER CARTRIDGE

BACKGROUND OF THE INVENTION

The present invention relates to a dispenser cartridge for the cooled storage and dispensing of liquid or semi-liquid foodstuffs, which is suitable for being replaceably received in a cartridge receiving space of a dispenser machine. The invention furthermore relates to a dispenser machine which is suitable for receiving the dispenser cartridge according to the invention.

Dispenser machines for the cooled dispensing of liquid or semi-liquid foodstuffs which are supplied in tubular bags are used in particular in fast-food outlets, in restaurants and catering companies. Many foodstuff products, such as milk, coffee cream, liquid egg and the like require that they are stored and dispensed cooled to reduce the risk of illness-inducing bacteria or pathogens. The American Food and Drug Administration (FDA) requires that dairy products such as milk and the like have to be stored at a temperature below 4.4° C. or 40° F. Correspondingly, such products are supplied in tubular bags in the already cooled state, at a temperature of between 0° C. and 4.4° C.

A typical device for the cooled storage and dispensing of liquid or semi-liquid foodstuffs is disclosed for example in EP 2 457 869 A. In this, a tubular bag is positioned upright in a chamber and is completely surrounded by a thermal transfer liquid. A cooling device as well as a pump for circulating the cooling liquid is present in the chamber containing the cooling liquid or thermal transfer liquid and the tubular bag. However, the tubular bag is not accommodated in a dispenser cartridge.

U.S. Pat. No. 6,056,157 discloses a dispenser machine having a dispenser cartridge which is suitable for receiving tubular bags. The solution demonstrated herein only discloses the option of a heated cartridge. The cartridge walls here are provided with a labyrinth of channels in which resistance wires extend so as to heat the entire cartridge. Whilst the solution according to U.S. Pat. No. 6,056,157 only discloses a dispenser machine for receiving a single cartridge, U.S. Pat. No. 6,419,121 B discloses a dispenser machine in which a plurality of cartridges are insertably and removably arranged next to one another and, with this, likewise solutions which disclose both cooling and heating. In particular for heating purposes, a cartridge is also proposed here, in the walls of which channels are present through which resistance wires extend so as to heat the entire cartridge and the tubular bag accommodated therein. In another solution according to FIGS. 11 to 14, a dispenser machine is disclosed, wherein the dispenser cartridges are stored at a spacing from one another in a cartridge receiving space of the dispenser machine. Cooled air is circulated for cooling purposes, wherein the cooled air is guided around the outside of the cartridges and therefore the cartridges have to be manufactured from a material with good thermal conductivity, i.e. in particular from metal. The cartridge itself is a simple box-like structure with a base and a lid connected thereto in a hinged manner.

All currently known dispenser machines for the cooled storing and dispensing of liquid and semi-liquid foodstuffs use the entire cartridge receiving space in the manner of a refrigerator and therefore cool both the cartridge receiving space and the dispenser cartridges with the tubular bag located therein. The energy consumption required for this is correspondingly high. Since cooled air should flow around the cartridges on all sides where possible, the spatial requirement is correspondingly high. If the font door of the dispenser machine is opened to replace a dispenser cartridge, a large proportion of the cooled air will flow out and be replaced by ambient air. This is comparable to a domestic refrigerator in which around 75% of the cooled air is replaced by ambient air when the refrigerator door is opened.

SUMMARY OF THE INVENTION

It is therefore the object of the present invention to provide a dispenser cartridge in which the cooled storage and dispensing of liquid or semi-liquid foodstuffs is possible with a lower energy consumption. This starts with a dispenser cartridge which is suitable for being replaceably received in a cartridge receiving space of a dispenser machine, which is equipped with cooling elements and fans, wherein the dispenser cartridge is formed from two thermoplastic cartridge shells which are connected to one another in a hinged manner and have a receiving space for a tubular bag, replaceably held therein, with a disposable pump, and in that means for holding the tubular bag and for the emptying thereof are present in the dispenser cartridge.

The object according to the invention is achieved in that each cartridge shell has a trough-shaped depression, formed outwards from the interior of the dispenser cartridge, which forms a cooling trough, which is terminated by a metal contact plate that separates the cooling trough from the receiving space, and in that each cartridge shell has a plug-in inlet port by means of which cooled air may be conducted into the cooling trough and can escape from the cooling trough via ventilation openings.

The invention furthermore proposes a dispenser machine for receiving dispenser cartridges, wherein the dispenser machine has a housing having a front door for opening the cartridge receiving space in which one or more dispenser cartridges may be inserted and are removably held, wherein the housing has a rear wall and, below the front door, an outlet for the cooled foodstuff for each dispenser cartridge. The dispenser machine here is notable in that the rear wall has injection ports into which the inlet ports of the dispenser cartridges may be introduced and suction openings from which the waste air from the cartridge receiving space may be recirculatably cooled via heat exchangers and returned into the dispenser cartridges through injection ports and the inlet ports. Such a dispenser machine is preferably furthermore notable in that the volume of the cartridge receiving space minus the maximum volume of the dispenser cartridges to be received in the cartridge receiving space corresponds to less than 10%, preferably between 2-3%, of the volume of the cartridge receiving space. The volume of the cooled air which is located in the cartridge receiving space and replaced by ambient air is thus correspondingly greatly reduced. This is also in particular the case in that, when a replacement cartridge with a full tubular bag which is already cooled is inserted, only a small volume of air has to be additionally cooled.

BRIEF DESCRIPTION OF THE DRAWINGS

In the accompanying drawing, both the dispenser cartridge and the corresponding matching dispenser machine are illustrated and explained with reference to the description below. In the drawing.

DETAILED DESCRIPTION

Figure 1:
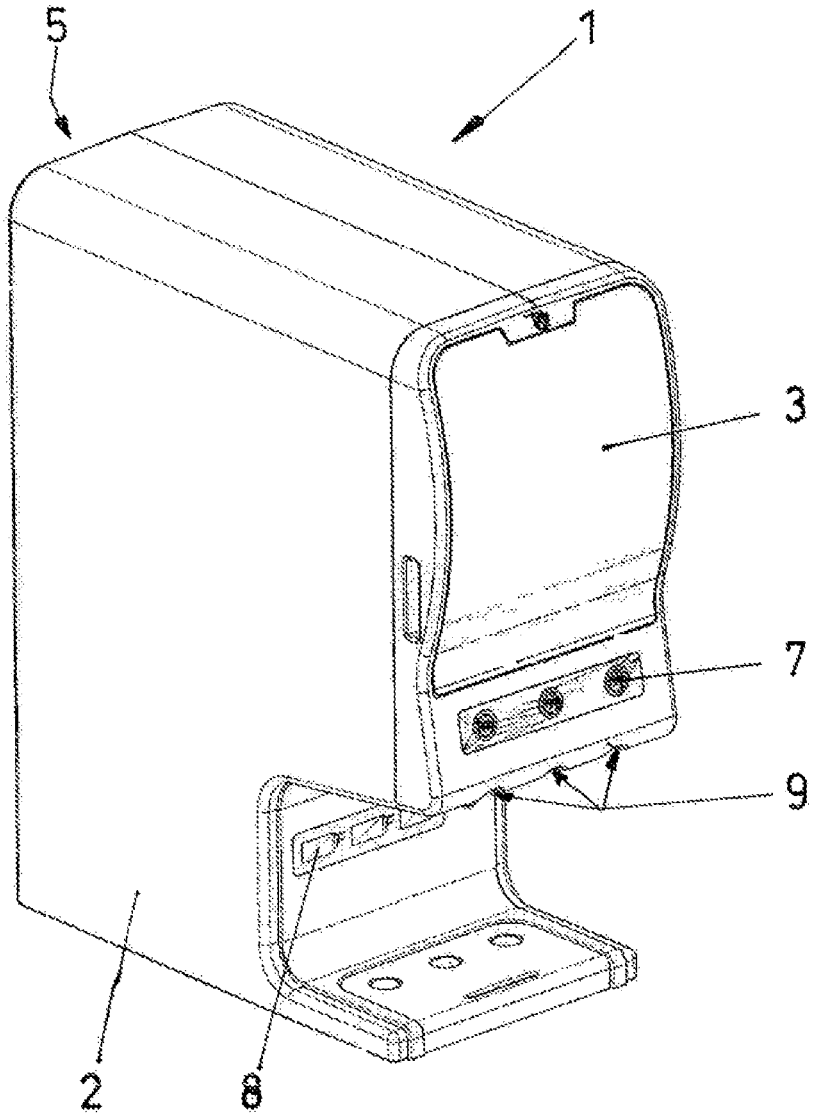
FIG. 1 shows a perspective view of the inventive dispenser machine for receiving the inventive dispenser cartridge in a state of use.

In FIG. 1, an exemplary embodiment of a dispenser machine is illustrated, which is suitable for receiving the dispenser cartridges according to the invention. The dispenser machine is denoted as a whole by 1. It comprises a housing 2 having a front door 3. The front door is mounted on the front side, which is the operating side. The front door 3 is a door which may be swung open and which has a recessed grip (correspondingly visible here) with which the front door can be opened. A row of three operating buttons 7 is visible in the lower region of the front door 3.

The dispenser machine 1 illustrated here is designed for receiving three dispenser cartridges 10. An operating button 7 is associated with each dispenser cartridge 10. Metering pumps operated by an electric motor are controlled by means of the operating buttons 7. The metering pumps are preferably designed as disposable pumps, whilst the motors driving these metering pumps are arranged in a fixed manner to remain in the dispenser machine 1. The arrow 9 points in the direction of the outlets (not visible here) of the three disposable pumps. Located below the front door is a recess, in the region of which a drip pan is arranged on which a receptacle catching the metered quantity of foodstuff may be seated. Arranged in a front wall below the front door is a display 8 on which, for example, the temperature in the cartridge receiving space 4 or in the dispenser cartridges 10 can be displayed. Correspondingly, the cartridge receiving space 4 and each dispenser cartridge 10 must then have a corresponding temperature sensor. However the metering quantity or other relevant data, such as the different substances contained in the dispenser cartridges or in the tubular bags in the corresponding dispenser cartridges 10, can also be displayed via the display 8.

Figure 2:
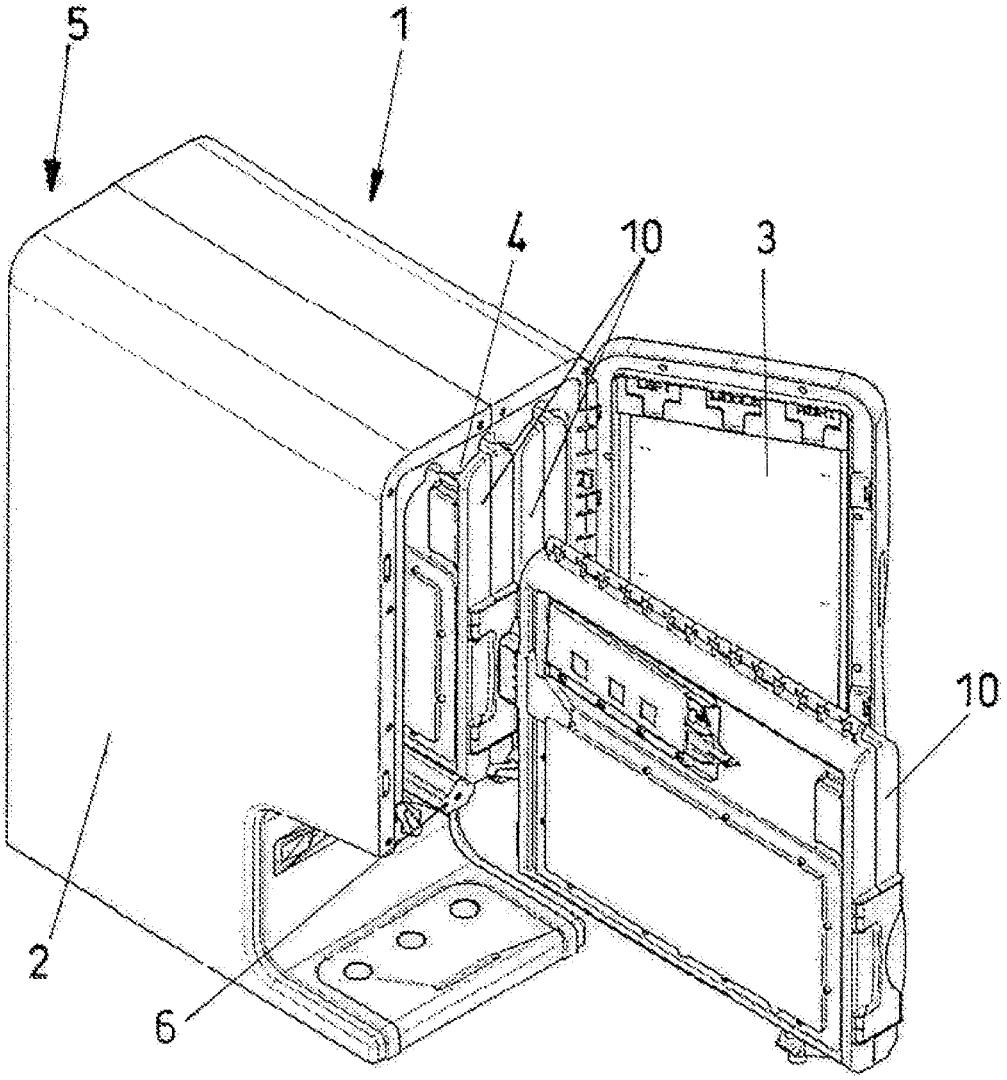
FIG. 2 shows the same dispenser machine according to FIG. 1, in the state with the front door open, with an inventive dispenser cartridge removed during a replacement stage.
Figure 3:
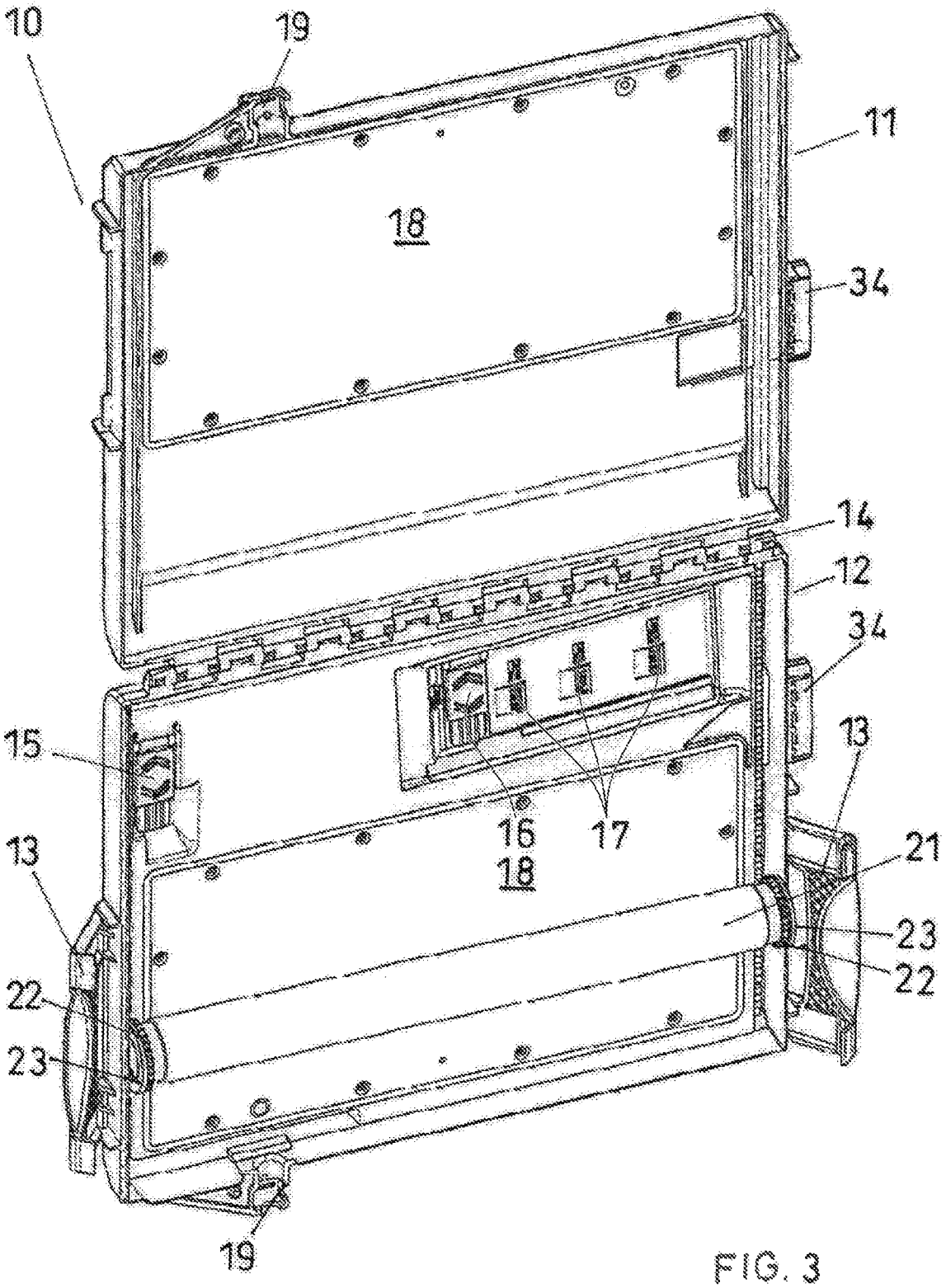
FIG. 3 shows the inventive dispenser cartridge in the open state omitting the tubular bag to be received therein, in turn in a perspective illustration.

FIG. 2 shows the dispenser machine from FIG. 1 in an open state, wherein the front door 3 is swung open and shows a dispenser cartridge 10 to be replaced in the removed state, whilst two further dispenser cartridges 10 are located in the cartridge receiving space 4. The dispenser cartridges 10 are relatively tightly packed when they are located in the cartridge receiving space 4. When introducing or removing the dispenser cartridges 10, these slide on corresponding slide rails 6. Corresponding connecting links, which enable precise guidance of the dispenser cartridges 10, are mounted in the cover region of the housing 2.

The outlet 9 for dispensing cooled foodstuffs in liquid or semi-liquid form is only partially still visible here. The outlet 9 is part of the disposable pump. The outlet of the disposable pump is fixed in a holder 19, which is part of the dispenser cartridge 10.

The dispenser cartridge is denoted as a whole by 10. It comprises a first cartridge shell 11 and a second cartridge shell 12. The two cartridge shells 11 and 12 are connected to one another via a hinge 14. Means for fastening a tubular bag to be placed in the second cartridge shell are present in this latter. These means comprise a fixed tubular bag clip 15 and an adjustable tubular bag clip 16. 17 denotes different adjustment positions for the adjustable tubular bag clip 16. Correctly, part of the holder 19 is of course present on each half of the cartridge shell 11, 12 so that the holder 19 holds the outlet 9 or the disposable pump in an enclosed manner in the closed state of the dispenser cartridge 10.

The tubular bag which is to be received in the dispenser cartridge 10 and is held by means of the two tubular bag clips 15, 16 is therefore placed into the shell 12, which is denoted here as the second cartridge shell, and then naturally covers essential parts which are of significance here, which is why the tubular bag is not illustrated. Therefore, whilst the tubular bag clips 15, 16 represent the means for holding the tubular bag, the means for emptying the tubular bag will also be briefly described here. Since the contents of the tubular bags can have a wide range of viscosities and can also exhibit different flow behaviors, for example a thixotropic flow behavior, gravity alone cannot guarantee that the tubular bag will empty as completely as possible. Even if the contents are practically sucked out by means of the pump, this in no way results in reliable, practically complete emptying of the tubular bag. A pressure roller 21 is correspondingly illustrated here, which has lateral toothed wheels 22 and outwardly corresponding pressure wheels 23. Whilst the toothed wheels 22 run on toothed racks 20, which are only present in the second cartridge shell 12, the pressure wheels 23 only lie on rolling tracks 24 in the first cartridge shell 11. The pressure roller 21 has a metal core with a relatively high specific weight and a sheath made from foam rubber is pulled over this metal core. A dispenser cartridge which has approximately the same structural design is already known from WO 2016/184633.

Finally, however, a respective thermally conductive plate 18 can be clearly seen in each of the two cartridge shells 11 and 12 in this illustration. In terms of their width, these thermal plates 18 are designed so that a tubular bag held between the two cartridge shells 11 and 12 abuts practically completely against the thermally conductive plates 18 on both sides in the completely full state. In other words, in terms of their width, the thermally conductive plates extend relatively near to the lateral toothed racks 20 in the second cartridge shell 12 and relatively near to the lateral rolling tracks 24 in the first cartridge shell 11. Therefore, in terms of their width, they are approximately 90% of the width of the corresponding cartridge shell. In terms of its height, each thermally conductive plate 18 corresponds approximately to ⅔ of the height of the respective cartridge shell 11, 12. The space in the upper third of the dispenser cartridge 10 is required for the holder of the tubular bag and for the pressure roller 21 if the tubular bag is completely full.

Figure 4:
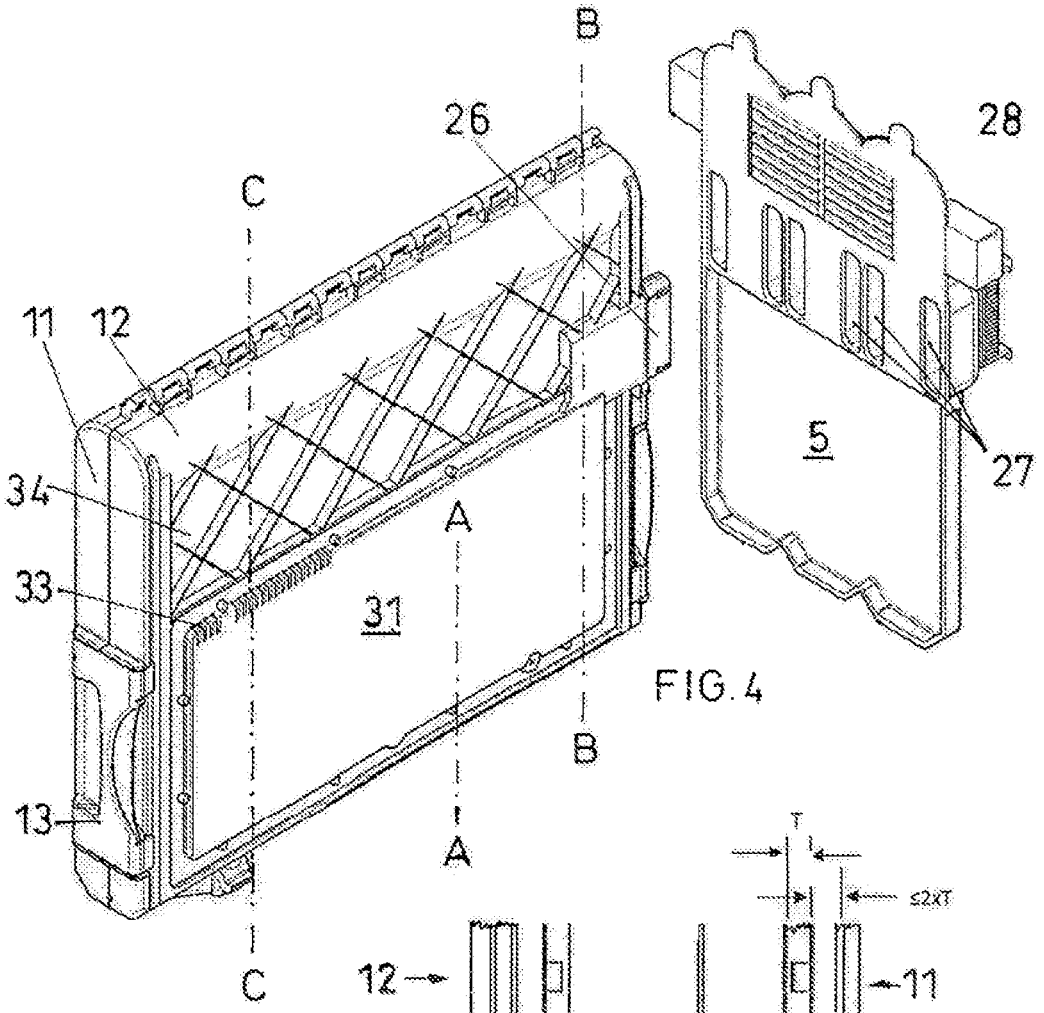
FIG. 4 shows the same dispenser cartridge in the closed state and the rear wall of the dispenser machine for explaining the cooperation between the dispenser cartridge and the dispenser machine, wherein a perspective illustration is in turn also shown here.

The dispenser cartridge 10 in the closed state and the rear wall of the housing 2 of the dispenser machine 1 are illustrated in FIG. 4. The rear wall 5 here can be seen looking onto the side situated towards the cartridge receiving space 4. The active units for cooling and recirculating the cooling air are located on the outside of the rear wall 5, which is part of the housing 2. Both the first cartridge shell 11 and the second cartridge shell 12 have an inlet port 26. Therefore, each dispenser cartridge 10 has two inlet ports 26. These inlet ports 26 fit positively and in a sealing manner in injection ports 27 in the rear wall 5 of the housing 2. Above these injection ports 27, there are suction openings 28 through which the cool air, which flows out of the dispenser cartridge 10 into the cartridge receiving space 4, is extracted to be cooled again and then fed back into the dispenser cartridge 10 via the injection ports 27 and through the inlet ports 26.

It is very important for the dispenser cartridge 10 according to the invention that a trough-shaped depression 29, formed outwards from the interior of the dispenser cartridge for receiving the tubular bag, is integrally formed both in the first cartridge shell 11 and in the second cartridge shell 12. This trough-shaped depression 29, together with the thermally conductive plate 18 terminating it, forms the cooling trough 30. The trough-shaped depression is formed by an outwardly offset plate part 31 of the respective cartridge shell 11, 12. The outwardly offset plate part 31 is supported on a circumferential wall 32. The depth of the cooling trough 30 is produced by the height of the circumferential wall 32.

Figure 4A:
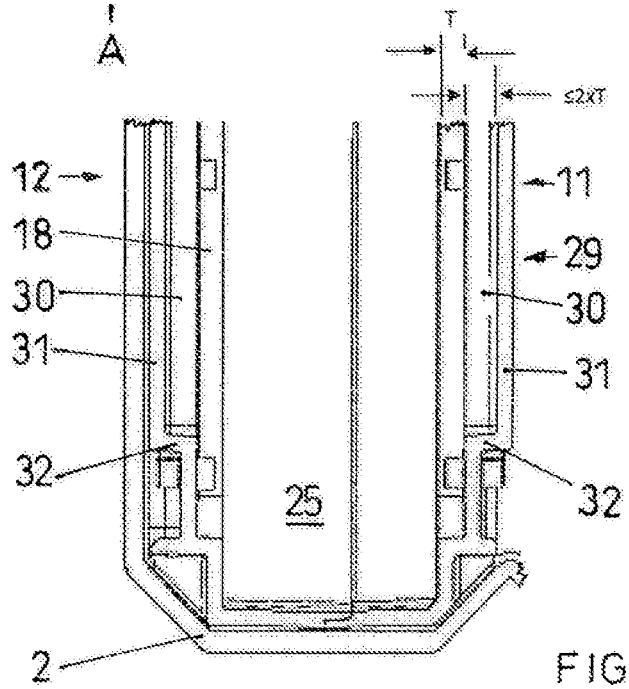
FIG. 4A shows a partial section through the dispenser cartridge along a line a-a in FIG. 4, whilst

As can be seen in FIG. 4*a*, the thickness of the thermally conductive plate 18 is denoted by T. The depth of the cooling trough 30, which is produced by the height of the circumferential wall 32 as mentioned, corresponds to a maximum of 2 T. The volume of the cooled air received in the cooling trough 30 is therefore relatively low. This cooled air is correspondingly replaced again in a correspondingly short time by the air which is cooled in a recycled manner. Since the thermally conductive plate 18 is made from metal, preferably from aluminum, and the outwardly offset plate part 31, the integral part of the corresponding cartridge shells 11, 12, is made from plastics material and therefore has a substantially lower thermal conductivity than the thermally conductive plate 18, the cooling trough 30 is therefore insulated to the outside. The cooling energy is therefore substantially transmitted to the thermally conductive plate 18 and from there to the tubular bag and its contents.

Figure 4B:
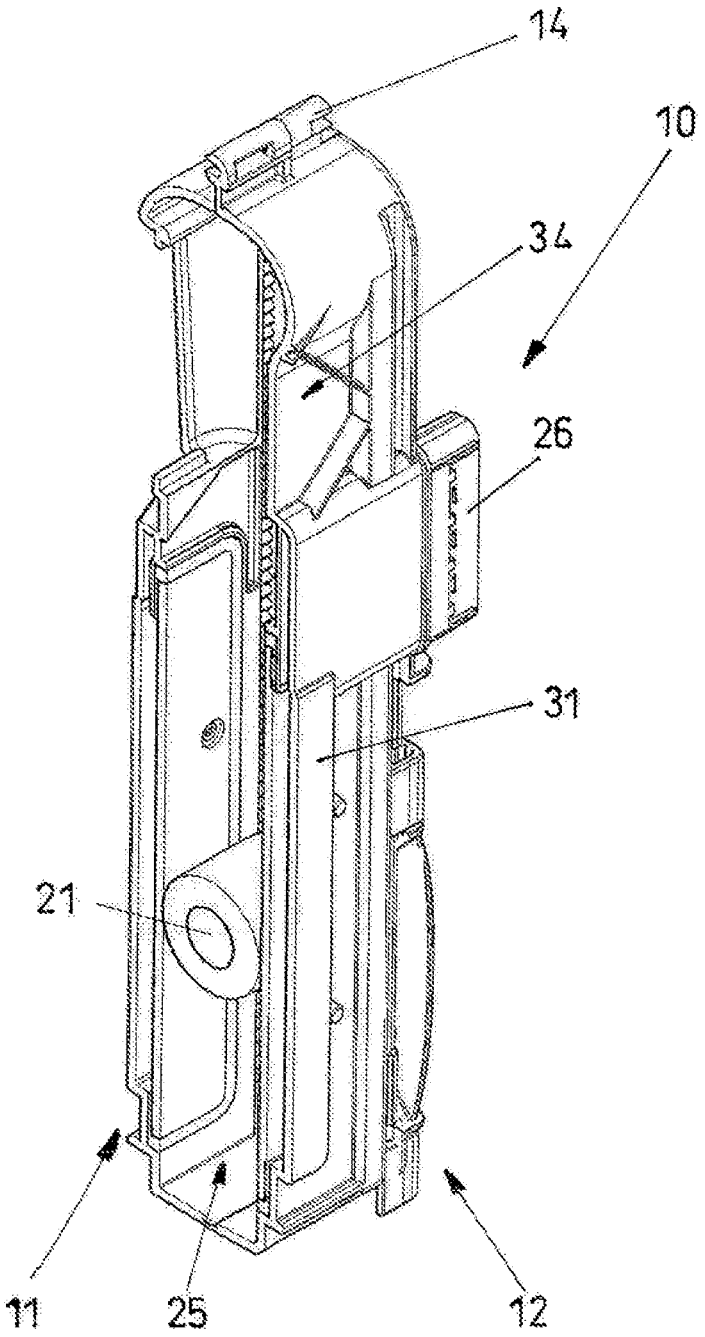
FIG. 4*b* shows a vertical section perpendicularly to the swivel axis of the two cartridge shells along the line b-b in FIG. 4 and, more precisely, in the region in which the inlet port of the dispenser cartridge leads into the cooling trough, whilst

It can be seen in FIG. 4*b*, which illustrates a vertical section through the dispenser cartridge 10, that the vertically upright dispenser cartridge 10 in the housing 2 protrudes further outwards in the lower region, in which the outwardly offset plate part 31 is located, than in the upper region above the inlet ports 26. This results in a part 34 of the dispenser cartridge 10 having a tapered cross-section above the inlet ports 26, which enables the free recirculation of the air flowing out of the cooling trough 30 through the ventilation openings 33 to the suction openings 28.

Figure 4C:
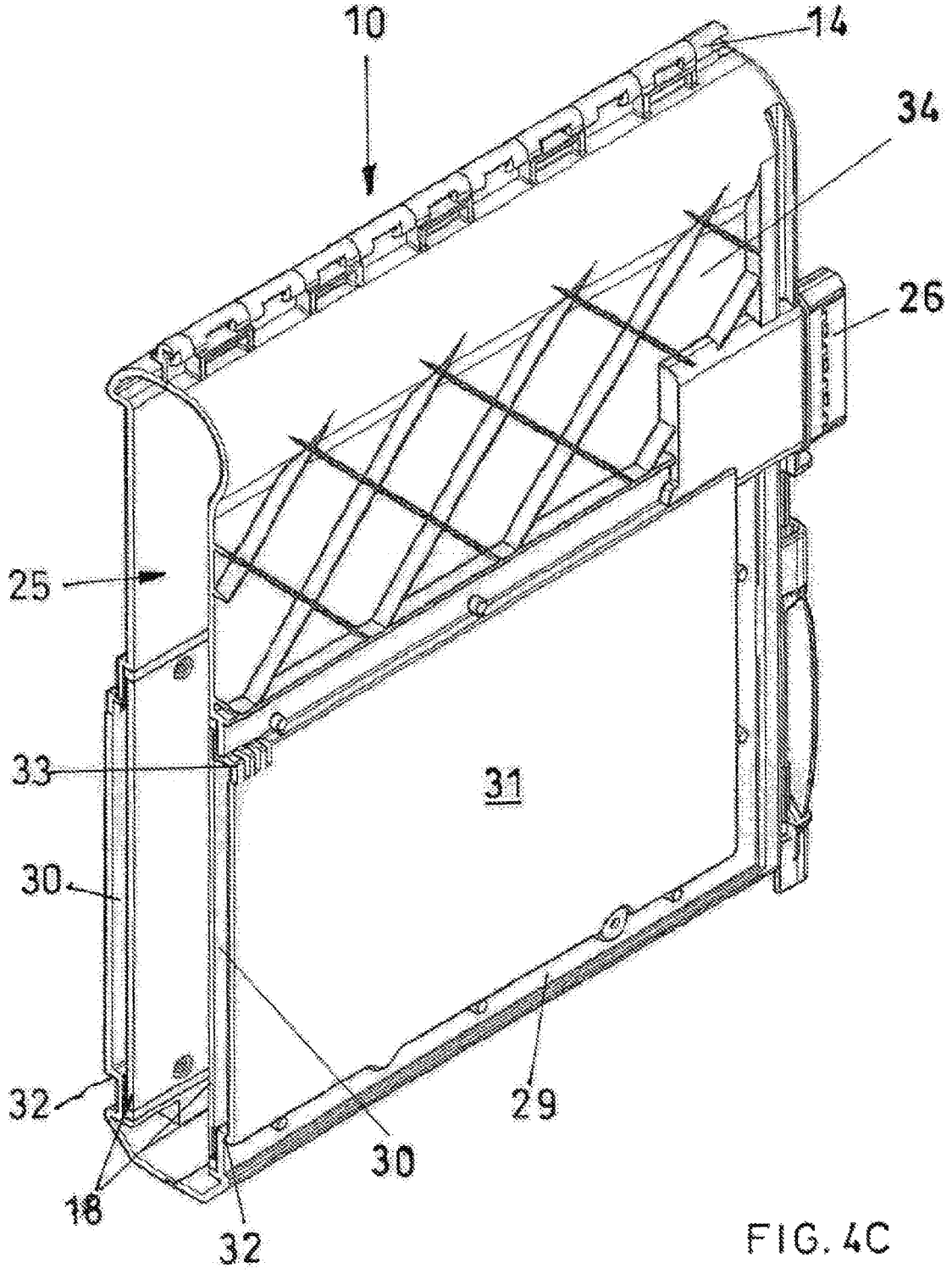
FIG. 4C illustrates a vertical section along the line c-c in FIG. 4, wherein this section shows the region of the ventilation openings in the cooling trough.

FIG. 4*c* illustrates a section along the line C-C in FIG. 4. The ventilation openings and the inlet port 26 are located at two mutually opposite ends of the upper edge of the cooling trough 30. The cold inflowing air sinks in the cooling trough 30 and is displaced by the following cold air in the direction of the ventilation openings, wherein it is heated and rises and therefore exits through the ventilation openings 33.

Figure 5:
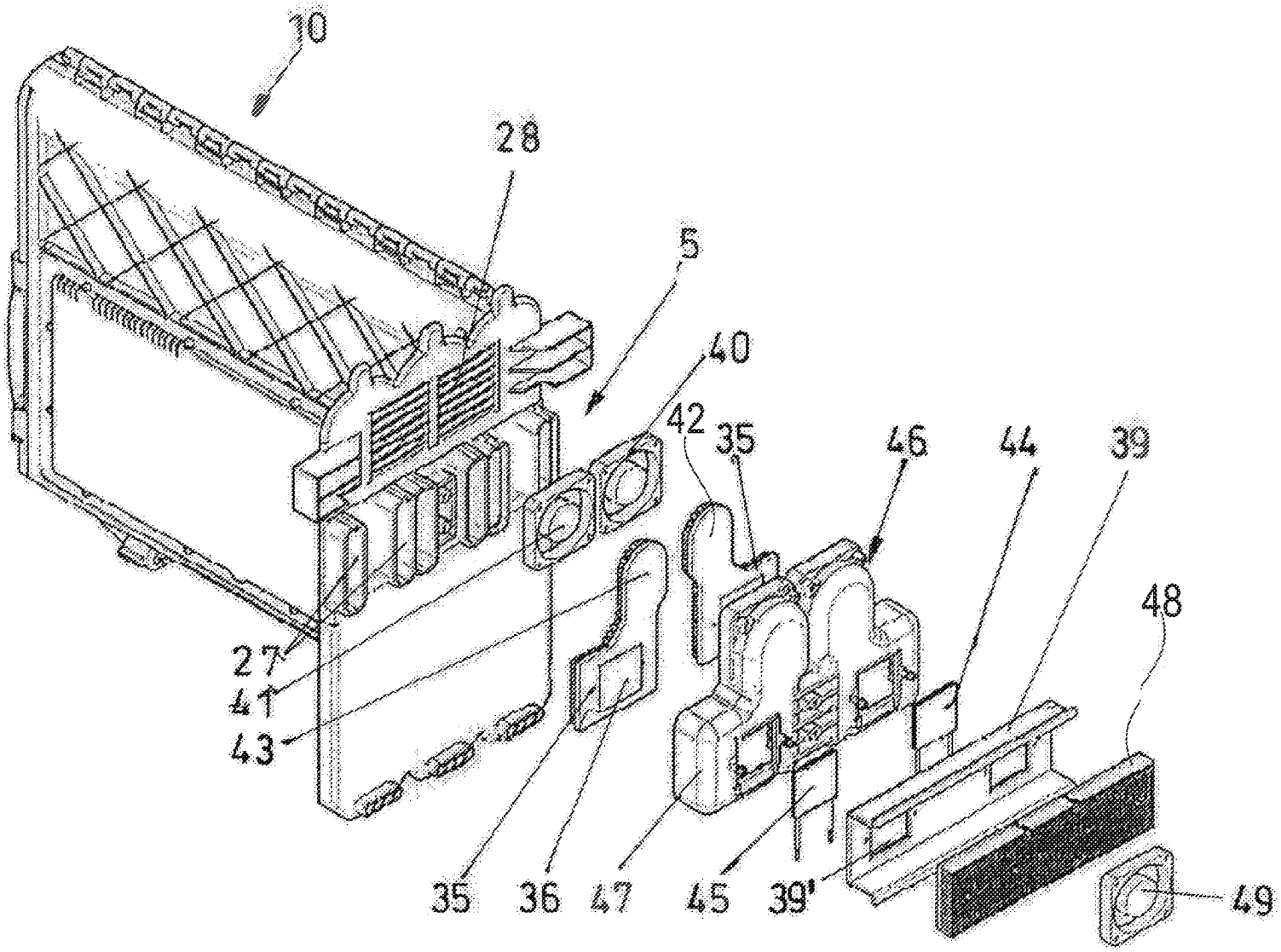
FIG. 5 shows an exploded illustration for explaining the air guidance between the dispenser machine and the dispenser cartridge, wherein individual parts of the air-guiding housing and the parts accommodated therein are visible.

To explain the air guidance between the dispenser machine and the dispenser cartridge, reference is now made to FIG. 5. In this, the rear wall 5 of the dispenser machine 1 is shown from the outer side of this rear wall 5 in an exploded illustration of the air-guiding housing and the components fastened therein or thereon, which are described below. The air-guiding housing comprises two mirror-symmetrical half parts 46 and 47. In these, there are two heat-exchanging elements which are likewise designed to be mirror-symmetrical, namely the heat exchangers 42 and 43. These heat exchangers 42 and 43 each comprise a respective plastics holding part 35 and a thermal contact plate 36 fastened therein. This thermal contact plate 36 is held in the respective plastics holding part by clamping or adhesion in a window formed therein. It goes without saying that a thermal insulation layer 37 is only fixed on the plastics holding part 35 to a limited extent and does not cover the thermal contact plates 36. As seen from the rear wall 5, two fans 40 and 41, which extract the air out of the cartridge receiving space 4 through the suction openings 28 and deliver it back into the dispenser cartridges 10, flowing into the injection ports 27, via the thermal contact plates 36, are located upstream of the two heat exchangers 42 and 43 but within the two housing parts 46 and 47.

The actual air-guiding housing comprises two mirror-symmetrical air-guiding housing halves 46, 47, although these can also be designed such that they are connected to one another in one part. A respective holding opening 38, in which a respective electrothermic cooling element 44, 45 is replaceably held, is integrally formed in each air-guiding housing half 46, 47. The electrothermic cooling elements are preferably Peltier elements. These Peltier elements 44, 45 have a cold side and a warm side. In the present case, the electrothermic cooling elements are arranged such that the cold side is directed towards the rear wall 5, whilst the warm side is arranged away from the rear wall 5. The cool sides of the two cooling elements 44, 45 are in contact with the thermal contact plate 36. A holding rail 39 is fastened to the outside of the two air-guiding housing halves 46, 47. This holding rail 39 has two heat radiation openings 39'. A hot-side heat exchanger 48 is held in the holding rail 39. A cooling fan 49 blows ambient air onto the hot-side heat exchanger 48 and therefore cools the electrothermic cooling elements 44, 45.

Thanks to the compact arrangement of the dispenser cartridges 10 in the cartridge receiving space 4 of the dispenser machine 1, the total volume of cooled air which has to be circulated is extremely low. The volume of the cartridge receiving space minus the maximum volume of the dispenser cartridges 10 to be received in the cartridge receiving space is therefore less than 10%. This volume is preferably between 3-8% of the volume of the total cartridge receiving space. When replacing a tubular bag which has to be inserted in a dispenser cartridge 10, the volume of the cooled air which is replaced by the ambient air is also extremely low. The tubular bag which is to be newly inserted already has the prescribed cooling temperature of 0° C.-+4° C. If a new full tubular bag is therefore to be inserted in an empty or emptied dispenser cartridge, this full tubular bag displaces the majority of the volume of the air in the receiving space 25 of the dispenser cartridge 10 into which the tubular bag is inserted. The differential volume which still contains ambient air is less than 20%, preferably approximately 8-15%, of the total volume of the receiving space 25. In particular, however, the proportion of the recirculating cooled air which is replaced by ambient air when the tubular bag is replaced in the system is very low.

Since the volume of the cooling trough 30 is very small, the energy requirement during normal operation of the dispenser machine when the dispenser cartridges 10 according to the invention are used is extremely low. This is ecologically and economically the desired aim of the present invention and this aim is optimally achieved.

Since, when a tubular bag is replaced, a tubular bag having the required temperature is in turn inserted, temperature monitoring in each dispenser cartridge is unnecessary. A temperature monitoring sensor is preferably mounted in the region near to the suction openings 28. The temperature is highest here. If this reaches an upper predetermined set temperature of 3.8° C., for example, the two electrothermic cooling elements 44, 45 are activated. If a lower temperature of 1.2° C. is measured, for example, these cooling elements 44, 45 are switched off.

LIST OF REFERENCE SIGNS

1 Dispenser machine
2 Housing
3 Front door
4 Cartridge receiving space
5 Rear wall of the housing 2
6 Slide rails
7 Actuating button
8 Digital display
9 Outlet
10 Dispenser cartridge
11 First cartridge shell
12 Second cartridge shell
13 Closing handle
14 Hinge
15 Fixed tubular bag clip
16 Adjustable tubular bag clip
17 Adjustment position for 16
18 Thermally conductive plate
19 Holder for outlet
20 Toothed rack
21 Pressure roller
22 Toothed wheels of the pressure roller
23 Pressure wheel of the pressure roller
24 Rolling track
25 Receiving space for tubular bag
26 Inlet port
27 Injection port
28 Suction openings
29 Trough-shaped depression
30 Cooling trough
31 Outwardly offset plate part of the cartridge shell
32 Circumferential edge
33 Ventilation openings
34 Tapered part of the dispenser cartridge 10
35 Plastics holding parts
36 Thermal contact plate
37 Thermal insulation layer
38 Holding opening
39 Holding rail
39' Heat radiation openings
40, 41 Fans
42, 43 Heat exchanger
44, 45 Electrothermic cooling elements
Peltier element
46, 47 Air-guiding housing halves
48 Hot-side heat exchanger
49 Cooling blower

The invention claimed is:

1. A dispenser cartridge (10) for cooled storage and dispensing of liquid or semi-liquid foodstuffs, the dispenser cartridge being configured to be replaceably received in a cartridge receiving space (4) of a dispenser machine (1) equipped with cooling elements and fans (40, 41), wherein the dispenser cartridge is formed from two thermoplastic cartridge shells (11, 12) which are connected to one another in a hinged (14) manner and which define a receiving space (25) for a tubular bag, replaceably held therein, with a disposable pump, and the dispenser cartridge comprising means (15, 16) for holding the tubular bag and emptying the tubular bag, wherein each of the cartridge shells (11, 12) has, formed outwards from the receiving space (25) of the dispenser cartridge (10), a trough-shaped depression (29) which forms a cooling trough (30), the cooling trough (30) being terminated by a metal thermally conductive plate (18) that separates the cooling trough (30) from the receiving space (25), wherein each cartridge shell has an inlet port (26) configured to be plugged into an injection port (27) of a dispenser machine (1) and to conduct a cooled air into the cooling trough (30), wherein each inlet port (26) has a projection extending from a respective one of the cartridge shells (11, 12), wherein each projection defines an opening which is configured to allow the cooled air to pass therethrough, and wherein each cartridge shell also has ventilation openings (33) configured to allow the cooled air to escape from the cooling trough (30).

2. The dispenser cartridge according to claim 1, characterized in that one of the cooling troughs (30) has a rectangular form and one of the thermally conductive plates (18) covers one of the cartridge shells towards the receiving space (25) for at least 75% of the width and at least 50% of the height.

3. The dispenser cartridge according to claim 1, characterized in that a depth of one of the cooling troughs (30) corresponds to a maximum of twice a thickness of one of the thermally conductive plates (18).

4. The dispenser cartridge according to claim 1, characterized in that a base of one of the cooling troughs (30) is surrounded by a circumferential wall (32) directed from the inside outwards and the base forms a plate part (31) of the dispenser cartridge (10), which plate part is offset outwards from the receiving space (25) for the tubular bag.

5. The dispenser cartridge according to claim 4, characterized in that the ventilation openings (33) of one of the cartridge shells are integrally formed in a region of the circumferential wall (32) and, in a position of use of the dispenser cartridge (10), are located above and on a side, which is arranged opposite the inlet ports (26).

6. The dispenser cartridge according to claim 1, characterized in that the inlet ports (26) are formed on a front end face of each cartridge shell (11, 12).

7. The dispenser machine (1) for receiving a plurality of dispenser cartridges (10) according to claim 1, wherein the dispenser machine (1) has a housing (2) having a front door (3) for opening a cartridge receiving space (4) configured to receive and removably hold one or more of the dispenser cartridges (10), wherein the housing (2) has a rear wall (5) and, below the front door (3), for each dispenser cartridge (10), an outlet (9) for the cooled foodstuff, characterized in that the rear wall (5) has the injection ports (27), which are configured to receive the inlet ports (26) of the dispenser cartridges (10), wherein the rear wall (5) also has suction openings (28) from which a waste air from the cartridge receiving space (4) is recirculatably cooled via heat exchangers (42, 43) and returned into the dispenser cartridges (10) through the injection ports (27) and the inlet ports (26) as the cooled air.

8. The dispenser machine according to claim 7, characterized in that an air-guiding housing (46, 47) is positioned over the suction openings (28) and one of the injection ports (27), wherein at least one fan (40, 41), a heat exchanger (42, 43) and at least one electrothermic cooling element (44, 45) are arranged in the air-guiding housing (46, 47).

9. The dispenser machine according to claim 8, characterized in that the at least one electrothermic cooling element (44, 45) is a Peltier element.

10. The dispenser machine according to claim 9, characterized in that a hot-side heat exchanger (48) is configured to guide an ambient air by means of a cooling blower (49) and abuts against a hot side of the Peltier element.

11. The dispenser machine according to claim 7, characterized in that a volume of the cartridge receiving space (4) minus a maximum volume of the dispenser cartridges (10) to be received in the cartridge receiving space (4) corresponds to less than 10% of the volume of the cartridge receiving space (4).

12. The dispenser machine according to claim 7, characterized in that a volume of the cartridge receiving space (4) minus a maximum volume of the dispenser cartridges (10) to be received in the cartridge receiving space (4) corresponds to between 3 and 8% of the volume of the cartridge receiving space (4).

13. The dispenser machine according to claim 7, characterized in that the cartridge receiving space (4) has space for three dispenser cartridges (10).

14. The dispenser machine according to claim 8, characterized in that a temperature sensor is arranged in the air-guiding housing (46, 47) or in the cartridge receiving space (4), wherein the temperature sensor is configured to measure the temperature of the cooled air flowing into the dispenser cartridges (10) through the injection ports (27) and the inlet port (26) or the waste air flowing out of the cartridge receiving space (4) through the suction openings (28), and wherein the electrothermic cooling element (44, 45) is configured to be activated if an adjustable limit temperature is exceeded.

15. The dispenser machine according to claim 7, wherein projections of the inlet ports (26) fit positively in the injection ports (27).

16. The dispenser machine according to claim 7, wherein the projections of the inlet ports (26) fit in a sealing manner in the injection ports (27).

17. The dispenser machine of claim 7, wherein the projections of the inlet ports (26) project outwardly from the cartridge (10), and wherein the injection ports (27) are apertures that are sized and shaped to receive the projections of the inlet ports (26).

18. The dispenser machine of claim 7, wherein each shell includes an inlet port (26), such that the two inlet ports (26) are arranged next to one another when the shells are brought together.

* * * * *